United States Patent [19]

Yokoi et al.

[11] 4,062,018

[45] Dec. 6, 1977

[54] SCANNING ANTENNA WITH MOVEABLE BEAM WAVEGUIDE FEED AND DEFOCUSING ADJUSTMENT

[75] Inventors: Hiroshi Yokoi, Machida; Masataka Akagawa, Yokohama, both of Japan

[73] Assignee: Kokusai Denshin Denwa Kabushiki Kaisha, Japan

[21] Appl. No.: 713,590

[22] Filed: Aug. 11, 1976

Related U.S. Application Data

[63] Continuation of Ser. No. 533,800, Dec. 18, 1974, abandoned.

[30] Foreign Application Priority Data

Dec. 21, 1973 Japan ..... 48-142384

[51] Int. Cl.[2] ..... H01Q 3/12; H01Q 19/14

[52] U.S. Cl. ..... 343/754; 343/761; 343/781 CA

[58] Field of Search ..... 343/761, 781 P, 781 CA, 343/840, 839, 754

[56] References Cited

U.S. PATENT DOCUMENTS

| | | | |
|---|---|---|---|
| 2,975,419 | 3/1961 | Brown | 343/754 |
| 3,641,577 | 2/1972 | Tocquec | 343/781 CA |
| 3,680,141 | 7/1972 | Karikomi | 343/781 CA |

*Primary Examiner*—Eli Lieberman

*Attorney, Agent, or Firm*—Robert E. Burns; Emmanuel J. Lobato; Bruce L. Adams

[57] ABSTRACT

An aperture antenna comprising at least one reflector, a primary radiator, and a plurality of movable beam-wave-guide reflectors arranged between the reflector and the primary radiator for directing electric waves from the primary radiator towards the reflector, in which at least one of the movable beam-waveguide reflectors is controlled to displace a feeding point to the reflector, and in which wavefront defocusing distortion of a radiated electric wave resulting from the displacement of the feeding point is corrected by moving at least one of the remaining movable waveguide reflectors.

9 Claims, 9 Drawing Figures

SCANNING ANTENNA WITH MOVEABLE BEAM WAVEGUIDE FEED AND DEFOCUSING ADJUSTMENT

This is a continuation, of application Ser. No. 533,800, filed Dec. 18, 1974 and now abandoned.

This invention relates to an aperture antenna capable of beam scanning.

In terrestrial stations for satellite communications, large aperture antennas are now employed and are generally constructed to be rotatable in all directions so as to follow a satellite wherever it may travel in space. However, present communication satellites are almost geostationary satellites and the range of movement is limited to a very small angle (about ± 1°). Accordingly, the use of an antenna capable of covering the entire scope of space is not economical. From this point of view, various studies have so far been made to obtain an antenna which scans within a limited, narrow angular range to permit economization and simplification of the antenna system, and many systems have heretofore been proposed. In one of these systems, beam scanning is achieved by tilting or shifting a subreflector of a cassegrain antenna, as shown hereinbelow. (1) Karikomi, Kumazawa and Kataoka: "Space Communication Antennas Designed By The Ray Lattice Method", Report of Technical Group of IECEJ, (Institute of Electronics and Communication Engineers of Japan) AP70-73(1971-02); (2) Urasaki and Mizusawa: "Radiation Characteristics of a Cassegrain Antenna With a Displaced Subreflector", Report of Technical Group of IECEJ, AP71-73 (1971-10)

However, these systems are effective from the economical point of view but defective in that maintenance of a moving mechanism of the subreflector is difficult and in that reliability is a little low.

An object of this invention is to provide an aperture antenna which is easy to maintain, highly reliable and capable of beam scanning.

The principle, construction and operation of this invention will be clearly understood from the following detailed description taken in conjunction with the accompanying drawings, in which.

Figure 1:
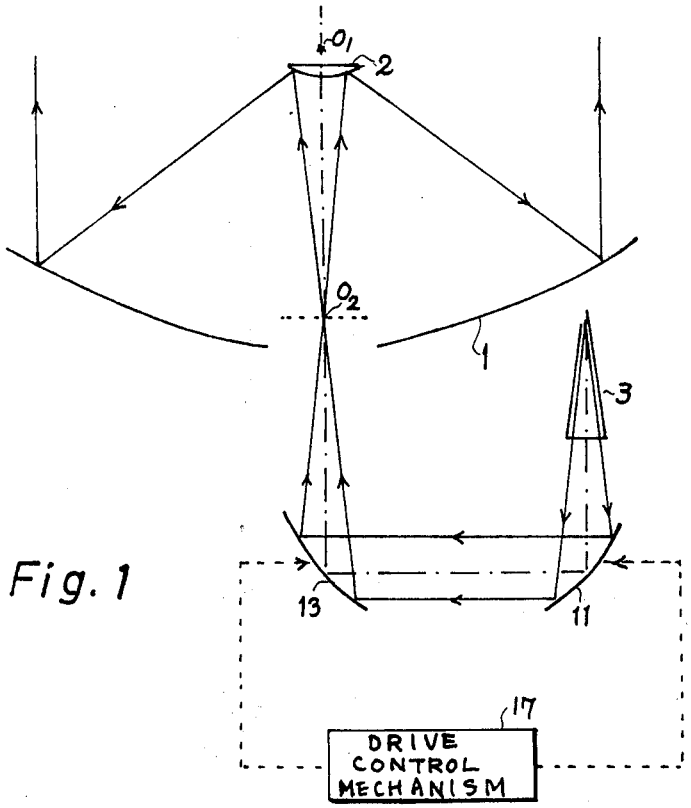
FIG. 1 is a schematic diagram showing the construction of one example of a Cassegrain antenna fed by beam-waveguide reflectors according to this invention.

With reference to FIG. 1 showing a schematic diagram of the construction of a Cassegrain antenna fed by beam-waveguide reflectors, the principle of this invention will be described. Electric waves emanating from a primary radiator 3 are reflected by a pair of movable parabolic reflectors 11 and 13, first converging on a point $O_2$, then divergingly radiating therebeyond to reach a subreflector 2, and finally reflected thereby to be directed through a main reflector 1. In the present invention, the above pair of movable reflectors 11 and 13 (in some cases, lenses are used in place of the reflectors) are moved to shift the position of the above point $O_2$, by which a beam from the main reflector 1 is scanned. The number of movable reflectors is not specifically limited to one pair but, in some cases, more than three reflectors may be used. Further, there are some occasions where a plurality of movable reflectors or lenses are disposed in the electric wave path between the primary radiator 3 and the main reflector 1 in place of the subreflector.

Figure 2:
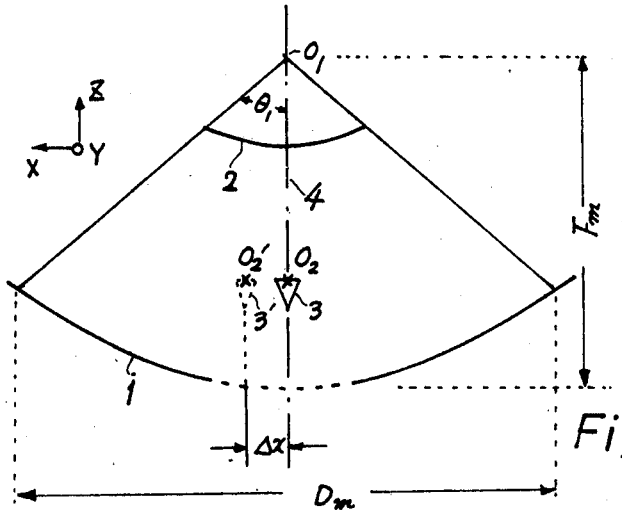
FIG. 2 is a schematic diagram illustrating the principle of beam scanning by shifting a primary radiator of the Cassegrain antenna.

Referring to FIG. 2 the invention will hereinbelow be described more in detail.

FIG. 2 schematically illustrates the construction of a conventional Cassegrain antenna. The surface of the main reflector 1 is of a paraboloid of rotation with its focal point at $O_1$. If the phase center of the primary radiator 3 dependent upon its radiation characteristic is noted as $O_2$, the subreflector 2 is of a hyperboloid of rotation with its conjugate focal points at $O_1$ and $O_2$. In FIG. 2, if the primary radiator 3 is shifted by a value $\Delta x$ in a direction perpendicular to the mirror axis 4, the beam scanning angle $\Psi$ is given as follows:

$$\psi = k\frac{e-1}{e+1}\cdot\frac{\Delta x}{Fm}\ \text{(radian)} \qquad (1)$$

where $e$ is the eccentricity of the subreflector 2, Fm is the focal length of the main reflector 1 and $k$ is the beam diviation factor. The beam diviation factor $k$ is a function of the ratio (F/D) of the main reflector focal length F and its aperture diameter D and, it is larger than 0.8 in conventional reflectors. However, if the scanning angle of an electric wave is large and the value $\Delta x$ becomes large, the wave front reflected by the main reflector differs from a plane wave. Accordingly, for beam scanning without deterioration of the antenna radiation characteristics, it is necessary to correct such a distortion of the wave front.

Figure 3:
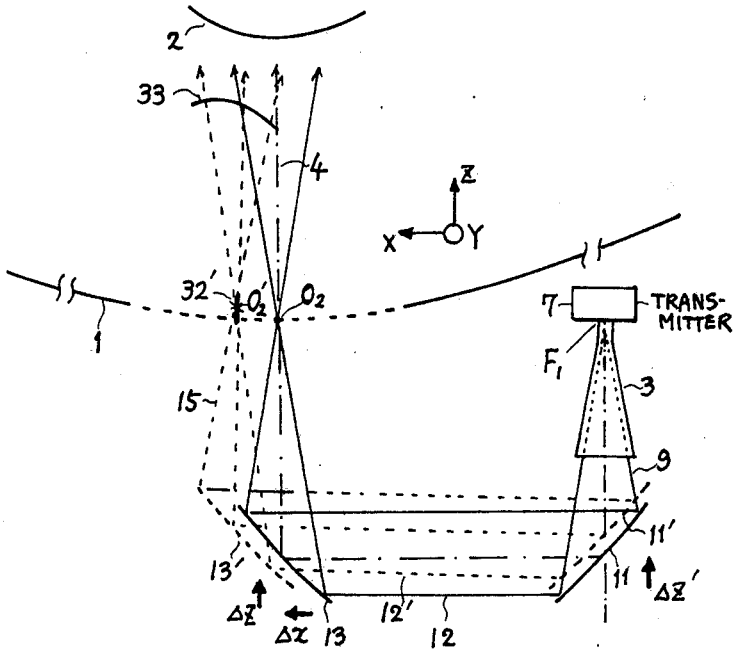
FIGS. 3, 4, 5, 6 and 8 are schematic diagrams illustrating the constructions of examples of this invention.

In FIG. 3, electric waves 9 emitted from the primary radiator (for example, a corrugated horn) connected to a transmitter 7 are rendered into parallel beams 12 by a movable parabolic reflector 11 with its focus at $F_1$, and the parallel beams 12 are converged by the other movable parabolic reflector 13 with its focus at $O_2$. The point $O_2$ is an equivalent feeding point of the primary radiation system to the Cassegrain antenna. From this point $O_2$, the electric wave is radiated to the subreflector 2 and the main reflector 1. In the present example, by shifting a reflector 13 making up the primary radiation system, the beam focusing point $O_2$ is displaced so that the wavefront defocusing of the radiated wave resulting therefrom is corrected by shifting the other reflector 11.

Next, this operational principle will be further described in detail. In FIG. 3, if the parabolic reflector 13 is moved in parallel by a value $\Delta x$ in the x-axis direction, its focus moves in parallel by the value $\Delta x$ in the x-axis direction. Further, if the parabolic reflector is moved in parallel by a value $\Delta z$ in the Z-axis direction as indicated by 13', the focus moves by the value $\Delta z$ in the Z-axis direction so that the focusing point $O_2$ is shifted to the position $O'_2$.

By moving the parabolic reflector 13 (including pivotal movement) as mentioned above, the focusing point is shifted. Then, if the parabolic reflector 11 is moved, for example, by a value $\Delta z'$ in the Z-axis direction as indicated by a reference numeral 11', the parabolic reflector 11' is defocusing relative to the focus $F_1$. Namely, the electric waves 12' reflected by the reflector 11' are again reflected by the reflector 13' and focused in the vicinity of the point $O'_2$ in a focal region having such a distribution as indicated by a reference numeral 32'. By an appropriate selection of the value $\Delta z'$, the radiating waves from the main reflector 1 are corrected. Thus, by slightly shifting a pair of reflectors in the beam transmission system (including pivotal shifting), the feeding point to the main reflector 1 can be effectively shifted, so that the beam of the antenna can easily be scanned through a very small angle.

The foregoing description has been given in connection with the case where the feeding point is displaced by shifting the one reflector 13 and the wavefront defocusing distortion caused by the displacement is corrected by shifting the other reflector. However, the deterioration of polarization characteristics and spillover from the main reflector 1 are also alleviated by moving the reflector 11.

No particular description has not been given of means for driving the reflectors 11 and 13 but they can be installed at a position near the ground in the construction of the antenna, so that driving of the reflectors may be automated by using motors or may be achieved by manual operation.

Figure 4:
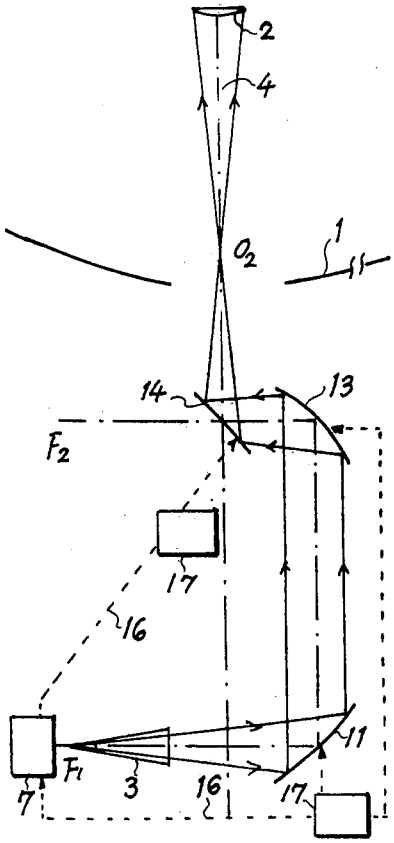

FIG. 4 illustrates another example of this invention in which a plane mirror 14 is added to the construction of FIG. 1. The focus $F_2$ of the parabolic reflector 13 and the point $O_2$ are symmetrical with each other with respect to the plane mirror 14. In the present example, an angular error between the direction of the radiated beam and that of a satellite is detected, and the error signal 16 is applied to a drive control mechanism 17 to drive the parabolic reflector 13, the plane mirror 14 and the parabolic reflector 11. If the deflector 11 is slightly moved, the wavefront defocusing distortion of the radiated beam is lessened.

Figure 5:
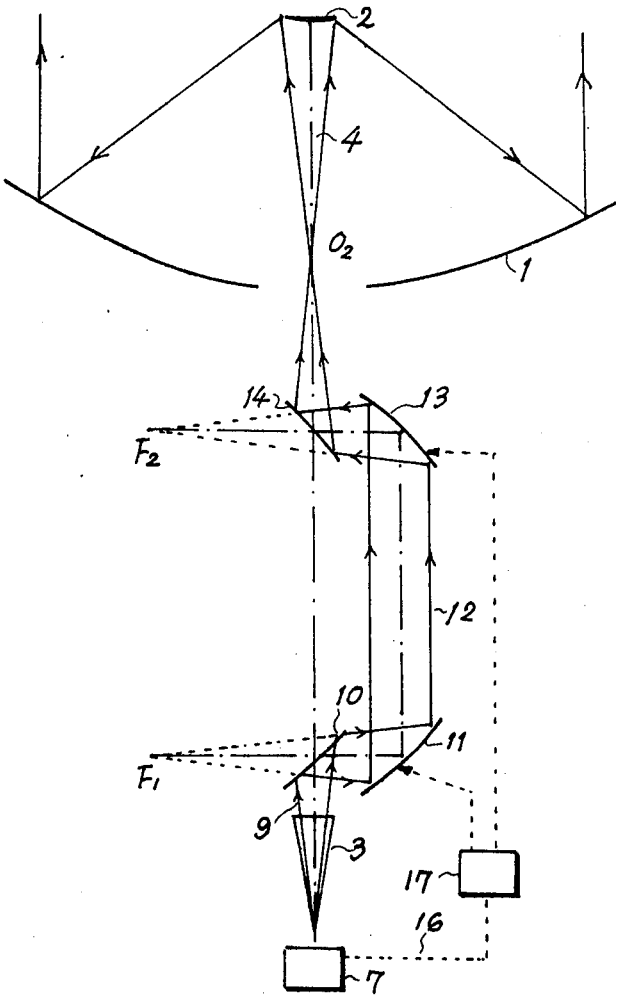
Figure 6:
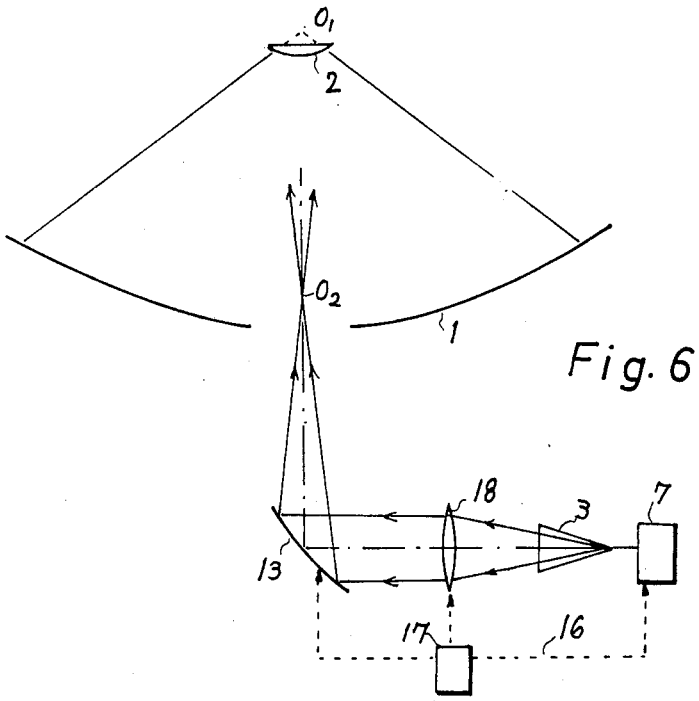

FIG. 5 shows another example of this invention in which two plane mirrors 10 and 14 are similarly added to the construction of FIG. 1. Further, FIG. 6 illustrates the construction employing a lens 18. Moreover, it is also possible to construct the primary radiation system only with lenses in place of the reflectors.

Also in such constructions as depicted in FIGS. 4 to 6, by shifting the reflector or lens forming the primary radiation system, the feeding point to the main reflector 1 is displaced and the wavefront defocusing distortion due to the displacement can be reduced. Further, such a construction as employing an elliptic reflector or a hyperbolic reflector is also possible.

Figure 7:
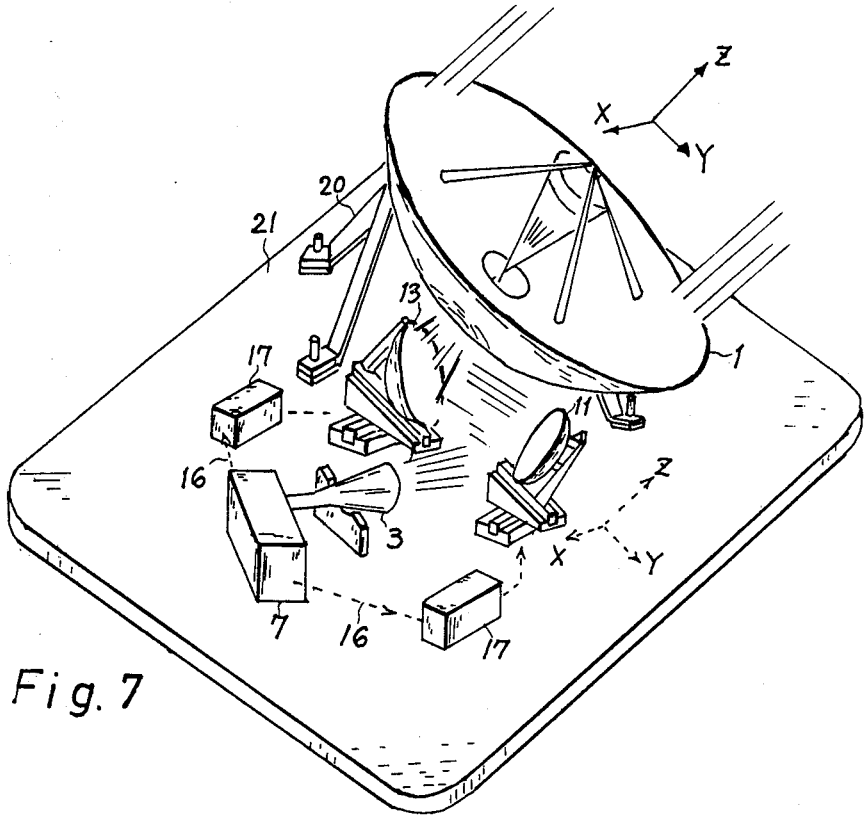
FIGS. 7 and 9 are schematic views showing other examples of this invention.

FIG. 7 is a schematic diagram showing a practical model of a terrestrial station antenna for satellite communications employing such beam-waveguide reflectors as depicted in FIG. 3. In FIG. 7, the main reflector 1 is fixed to the ground 21 by a support structure 20. If the co-ordinates X, Y and Z are taken as shown, one parabolic reflector 13 of the primary radiation system is adapted to be driven in the X, Y and Z directions for displacing the feeding point and the other parabolic reflector 11 is also adapted to be driven in the X, Y and Z directions for correcting the wave front. By detecting an angular error between the direction of the satellite and that of the antenna beam and by applying the error information 16 to the drive control mechanism 17, the parabolic reflectors 11 and 13 are shifted.

Figure 8:
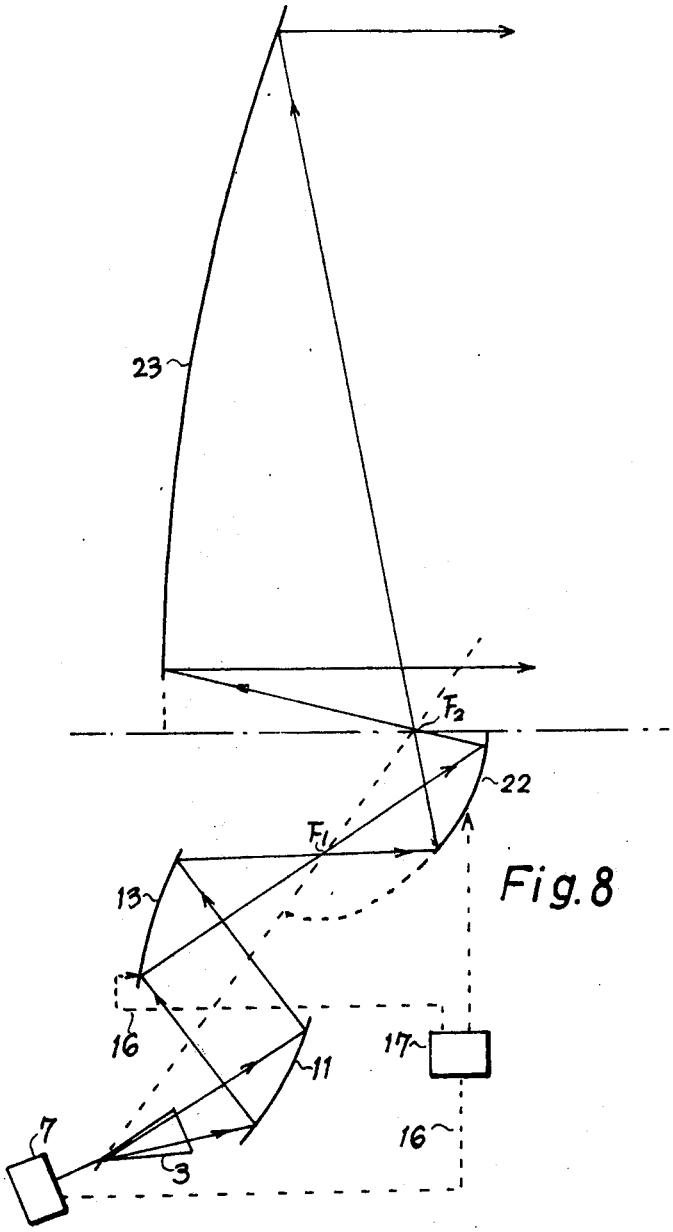
Figure 9:
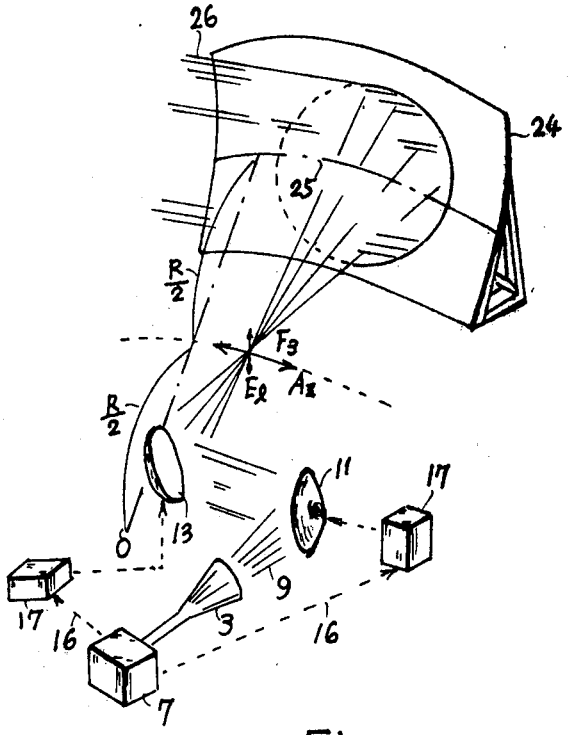

The foregoing description has been given with regard to the case where the aperture antenna is a Cassegrain antenna. The following will describe other antennas. FIG. 8 shows an example of this invention applied to an offset parabolic antenna and FIG. 9 shows another example of this invention applied to a parabolic torus antenna. In FIG. 8, beams emanating from a feeding radiator 3 are rendered by the parabolic reflector 11 into parallel beams and focused on the focus $F_1$ by the parabolic reflector 13, and further focused by the elliptic reflector 22 on the other focus $F_2$ thereof. This focus $F_2$ is also the focus of an offset parabolic reflector 23, so that if the elliptic reflector 22 and the parabolic reflector 13 are shifted in one piece in the X, Y and Z directions, the feeding point $F_2$ of the offset parabolic reflector 23 is equivalently displaced and, by shifting the other parabolic reflector 11, correction of the wave front is achieved.

FIG. 9 illustrates the torus antenna using a torus reflector 24 fed by beam-waveguide reflectors.

The torus reflector 24 has a parabolic surface in one direction (in a vertical direction in this case) and a spherical surface having a radius of curvature R in the other direction (in a horizontal direction). In FIG. 9, beams 9 emanating from the radiator 3 are focused by two parabolic reflectors 11 and 13 on a point $F_3$. The point $F_3$ is the middle point of the sphere's center O and the reflecting surface 25. In this example, in accordance with this invention, the two parabolic reflectors are suitably moved so as to displace the feeding point $F_3$. Namely, one parabolic reflector 13 is pivoted about the sphere's center O (moving in the horizontal direction) and the other parabolic reflector 11 is moved in the vertical direction, by which the beams 26 from the antenna can be scanned in the horizontal and vertical directions.

In case of beam scanning in the antenna of this invention, an increase in the scanning angle causes a decrease in the antenna gain. When the scanning angle is relatively large, it is effective for the purpose of alleviating the gain reduction to only slightly move the primary radiator, to make the feed reflectors to be a little larger and to construct the antenna surface in accordance with the Ray Lattice Method discussed in the aforementioned reference (1).

As has been described in the foregoing, the beam scanning in the antenna of this invention can be readily achieved by driving the above-mentioned compact mechanism, when a large diameter antenna follows a geostationary satellite whose direction slightly changes within a limited range. This invention is not only advantageous from the economical point of view but also capable of greatly lessening the influence of a wind because the main reflector or both of the main reflector and the subreflector can be fixed, thus allowing ease in maintenance and providing for enhanced reliability.

What we claim is:

1. An aperture antenna, comprising:

a. a fixed main parabolic reflector having a parabolic reflecting surface;

b. a primary radiator for radiating electromagnetic radiation;

c. a pair of movable auxiliary parabolic reflectors positioned between said main reflector and said primary radiator for reflecting electromagnetic radiation from said primary radiator along a path towards the parabolic reflecting surface of said main reflector, one of said auxiliary reflectors being positioned closer to said main reflector than the other of said auxiliary reflectors;

d. first control means operable for controlling the position of the closer one of said auxiliary reflectors along the path of electromagnetic radiation to displace the area of the parabolic reflecting surface irradiated by the electromagnetic radiation thereby to change the direction of electromagnetic radiation reflected from said main reflector; and e. second control means operable for controlling the position of the other of said auxiliary reflectors to displace it in a direction effective to correct for wavefront defocusing distortion of the electromagnetic radiation reflected from said main reflector caused by the displacement of said closer one of said auxiliary reflectors.

2. An aperture antenna according to claim 1, further comprising:

a plane reflector positioned along the path of electromagnetic radiation for reflecting electromagnetic radiation thereby to change the direction of the path of electromagnetic radiation.

3. An aperture antenna, comprising:

a. a fixed main parabolic reflector having a parabolic reflecting surface;

b. a sub-reflector disposed at a fixed position and with a fixed orientation with respect to said main parabolic reflector, said sub-reflector being orientated with respect to said main parabolic reflector to receive electromagnetic radiation and reflect the received electromagnetic radiation onto said main parabolic reflector;

c. a movable auxiliary parabolic reflector positioned to receive electromagnetic radiation and reflect the same onto the reflecting surface of said sub-reflector;

d. control means operable for controlling the position of said auxiliary reflector to displace the area of the parabolic reflecting surface irradiated by the electromagnetic radiation thereby to change the direction of electromagnetic radiation reflected from said main reflector; and e. radiating means for radiating electromagnetic energy in a direction to irradiate said auxiliary reflector, said radiating means comprising correcting means for correcting wavefront defocusing distortion of the electromagnetic radiation reflected from said main reflector caused by the displacement of said auxiliary reflector.

4. An aperture antenna according to claim 3, wherein said radiating means comprises:

a. a primary radiator for radiating electromagnetic radiation;

b. a second movable auxiliary reflector positioned for reflecting the electromagnetic radiation along a path from said primary radiator to the first-mentioned auxiliary reflector; and c. second control means operable for controlling the position of said second auxiliary reflector to correct wavefront defocusing distortion of the electromagnetic radiation reflected from said main reflector caused by the displacement of the first-mentioned auxiliary reflector.

5. An aperture antenna according to claim 4, wherein both of said auxiliary reflectors comprise parabolic reflectors.

6. An aperture antenna, comprising:

a. a fixed main parabolic reflector having a parabolic reflecting surface;

b. a movable auxiliary parabolic reflector positioned to receive electromagnetic radiation and reflect the same onto the parabolic reflecting surface of said main reflector;

c. control means operable for controlling the position of said auxiliary reflector to displace the area of the parabolic reflecting surface irradiated by the electromagnetic radiation thereby to change the direction of electromagnetic radiation reflected from said main reflector reflector; and d. radiation means for radiating electromagnetic energy in a direction to irradiate said auxiliary reflector, said radiation means comprising a primary radiator for radiating electromagnetic radiation, a movable lens positioned for directing the electromagnetic radiation along a path from said primary radiation to said auxiliary reflector, and control means operable for controlling the position of said lens to correct wavefront defocusing distortion of the electromagnetic radiation reflected from said main reflector caused by the displacement of said auxiliary reflector.

7. An aperture antenna according to claim 1, wherein the parabolic reflecting surface of said main reflector is a paraboloid of revolution.

8. An aperture antenna according to claim 1, wherein the parabolic reflecting surface of said main reflector is a toroidal section having a parabolic curvature along a first dimension and a spherical curvature along a second dimension.

9. A beam scanning aperture antenna system, comprising:

a. a main parabolic reflector including a parabolic reflecting surface;

b. a sub-reflector disposed at a fixed position and with a fixed orientation with respect to said main parabolic reflector, said sub-reflector being orientated with respect to said main parabolic reflector to receive electromagnetic radiation and reflect the received electromagnetic radiation onto said main parabolic reflector;

c. means for illuminating said sub-reflector with electromagnetic radiation, said means for illuminating comprising a first movable auxiliary reflector having a reflecting surface curvature of second degree and positioned to reflect electromagnetic radiation onto said sub-reflector and movable to change the direction of the electromagnetic radiation reflected from said sub-reflector to said main parabolic reflector in order to effect beam scanning, a second movable auxiliary reflector having a reflecting surface curvature of second degree and positioned to reflect electromagnetic radiation onto said first auxiliary reflector and movable for correcting wavefront defocusing distortion of the electromagnetic radiation reflected from said main reflector caused by the change of the direction of the electromagnetic radiation incident on said sub-reflector to effect beam scanning, and d. a source of electromagnetic radiation positioned to illuminate said second auxiliary reflector with electromagnetic radiation, said source, first and second auxiliary reflectors being relatively positioned to define a path for electromagnetic radiation from said source to said second auxiliary reflector to said first auxiliary reflector to said sub-reflector.

* * * * *